US005128644A

United States Patent [19]

Nellessen

[11] Patent Number: 5,128,644

[45] Date of Patent: Jul. 7, 1992

[54] REUSABLE COMBINATION COW MAGNET ASSEMBLY AND FLUID TREATMENT MAGNET

[76] Inventor: John E. Nellessen, 21 Rock La., Castle Rock, Colo. 80104

[21] Appl. No.: 580,941

[22] Filed: Sep. 11, 1990

[51] Int. Cl.[5] ..... H01F 7/02

[52] U.S. Cl. ..... 335/306; 600/12

[58] Field of Search ..... 335/302, 306, 303, 305; 210/222; 600/9, 12; 606/106

[56] References Cited

U.S. PATENT DOCUMENTS

| | | | |
|---|---|---|---|
| 2,613,246 | 10/1952 | Spodig | 335/305 |
| 2,853,075 | 9/1958 | Hoffman et al. | 606/106 |
| 3,005,458 | 10/1961 | Brook et al. | 606/106 |
| 3,153,177 | 10/1964 | McFadyen | 335/306 |
| 4,283,698 | 8/1981 | Fujisawa | 335/306 |
| 4,303,062 | 12/1981 | Vars | 606/106 |
| 4,427,960 | 1/1984 | Wuerfel | 335/306 |
| 4,749,978 | 6/1988 | Imamura | 335/302 |

FOREIGN PATENT DOCUMENTS

| | | | |
|---|---|---|---|
| 1136791 | 4/1963 | Fed. Rep. of Germany | 606/106 |
| 1130335 | 12/1984 | U.S.S.R. | 600/12 |

*Primary Examiner*—Leo P. Picard
*Assistant Examiner*—Trinidad Korka

[57] ABSTRACT

An assembly of annularly shaped, permanent magnets (1) and durable, magnetic conducting metal, annularly shaped, pole pieces (2) stacked on a non-magnetic, durable metal, center rod (3), held by threaded, durable, magnetic conducting metal, rounded, end plates (4) and thread locking adhesive. The magnets 1 being unmagnetized before assembly. Then being magnetized as a whole assembly.

5 Claims, 3 Drawing Sheets

REUSABLE COMBINATION COW MAGNET ASSEMBLY AND FLUID TREATMENT MAGNET

BACKGROUND

1. Field of Invention

This invention relates to magnetic assemblies, specifically for retaining ferrous materials in the Rumen (upper stomach) of cows to protect the reticulum (lower stomach) and vital organs from Hardware Disease, with high magnetic and physical durability to be reused for other cows or also disassembled for multiple experiments in the science of magnetics.

2. Description of Prior Art

Cows have been known to accidentally eat fencing staples, bailing wire remnants, nails, etc. while grazing. Cow magnets are administered orally to cows to attract and retain ferrous material within the Rumen (upper stomach). The magnetic assembly is heavy enough to prevent passage from the Rumen. The magnetic assembly remains in the Rumen collecting iron particles and retaining them within the Rumen for the entire life of the cow. Retention of sharp iron pieces within the Rumen greatly reduces the possibility of damage to other more delicate, vital organs. Damage to intestines, organs, etc. caused by ingestion of iron objects often causes the animal to stop eating and eventually expire. The cause of death is then categorized as "Hardware Disease."

Heretofore cow magnets have not adequately fulfilled the necessity for the magnet to last more than the lifetime of the cow. Various types of cow magnets have been available over the past thirty years and have contributed greatly to the prevention of Hardware Disease. I will address the following main problems:

(1) Some older designs are made of a magnetically inferior material (Alnico of various grades) which is more subject to demagnetization.

(2) Some older designs are made from Barium Ferrite blocks which are very fragile and could only be magnetized in a direction that caused some sharp long objects to be held dangerously perpendicular to the magnet surface.

(3) The magnetic assembly by Fujisawa U.S. Pat. No. 4,283,698 is the only assembly type cows magnet comparable to the present invention. The Fujisawa Magnet is magnetically proper. Unfortunately it is structurally weak and could be a great danger to the cows. The structural weakness is due to the use of a steel screw to fasten the plastic center rod and the plastic end pieces (See U.S. Pat. No. 4,283,698 FIGS. 1, 2 and 4 detailing components 3 and 3'). In the final stage of the assembly process, as the self tapping screw is inserted into the flat end of the plastic rod, the plastic rod is stressed, stretched, cracked and sometimes stripped out. The use of a steel screw with a weaker material (plastic) thread does not make a secure fastening system for the environment the magnet will be in. Immediate detection of failure of this type is difficult because the actual time of failure can occur after the finished product has been packaged and shipped. The timing of the stress seperation can vary depending upon how tight the screw is and other obvious variables. Excessive rejects due to material fatigue have been found to occur in shipping and after the magnet has been administered to the cows. Failures of the magnet occuring during packaging, shipping, distribution and in the cows can lead to serious consequences. Undetected failures which are administered to the cows and/or failures which occur within the Rumen can, in and of themselves, be the cause of serious damage or death of the animal. There have been many reported structural failures of magnets produced according to the Fujisawa U.S. Pat. No. 4,283,698 both during shipping and after being administered to cows.

This was an unrecognized problem brought to our attention by distributors and end users. Veterinarians and farmers have reported many cases of failed magnets being discovered in pastures after being passed by a cow. Not knowing which animal of the herd has passed the magnet poses two other problems. Which animal to check for injuries and which animal now has no magnet to protect against "Hardware Disease"?

Acids from the stomach loosen and dissolve the small steel screw tightened into plastic which is used to hold the entire Fujisawa U.S. Pat. No. 4,283,698 magnet assembly together. First, when the plastic rod separates, the magnets repel against each other, pushing one or two segments off the end of the rod, exposing the split or broken end of the rod. Second, the loose magnet segments and steel washers form a mass along with the now exposed pointed screw and end cap. Third, the mass now becomes a size and shape that can be passed through the digestive system. The passage of the large mass of magnets, steel washers, broken plastic rods and sharp steel screws can cause blockage of the digestive tract, internal bleeding, and/or piercing of vital organs.

Acids from the stomach can loosen or dissolve the small steel screw which is used to hold the entire Fujisawa U.S. Pat. No. 4,283,698 magnet assembly together. The small steel screw is only 0.107 inches in diameter by 0.750 inches long. An iron nail 0.125 inches in diameter can dissolves 40% in six to twelve months in the cow's Rumen. The black zinc plating used on the small screw will increase the resistance to the acid by four to six times. This means the small steel screw could dissolve in as little as two years and may last as long as six years. This is assuming the plastic lasts this long. Beef cattle may serve their useful lives in the two to six year time frame but, dairy cows are expected to live far beyond the six year life of the small screw.

(4) The standard magnetic configuration adapted for Fujisawa U.S. Pat. No. 4,283,698 on August 1981 is inconistent magnetically from one end to the other. Heretofore, this type of assembly had to be assembled with the magnet segments in the magnetized condition and in a specific order of polarity. Assembling magnets to steel in the repelling sequence required, creates a flux loss from 5 to 10 percent and flux variation from one end to the center of the unit of 25 to 30 percent.

Using the standard holding magnet pattern (steel-magnet-steel-magnet-steel) with the inner steel components having a common polarity, has been a standard practice since early 1960. One evidence of this is the holding magnet design of U.S. Pat. No. 3,014,751 from 1961. The capability of magnetizing this type of magnet assembly after the completion of the assembly process has not heretofore been feasible so cow magnets have been limited to less than optimum magnetic efficiency.

(5) The magnets are magnetized before assembling and force together repelling. U.S. Pat. No. 4,283,698 states under claims 1c "said magnets being arranged such that the magnetic poles of the magnets confronting each other . . . ". This requires one hand to stack the assembly while the other hand keeps it from repelling apart. This requires some training and unnecessary effort. This requires both hands per magnet assembly. This will not lend itself to automated assembly by a vibratory feeder as is common in the industry for other assemblies. To automate the assembly of magnetized magnets is very costly.

(6) There are Four extra pieces in U.S. Pat. No. 4,283,698 (FIG. 4 #2). The two plastic end plates are non-beneficial to the magnetic strength of the assembly. Therefore two extra steel plates per end must be added to complete the magnetic circuit. Plastic end plates are also non-beneficial to the structural integrity. Four extra pieces are also four more places for defects in assembly. Four extra pieces also cost more.

(7) No other applications have been discovered and recommended for the Fujisawa U.S. Pat. No. 4,283,698. It only serves one purpose.

OBJECTS AND ADVANTAGES (1) The magnet material used is permanently magnetized ferrite rings. The magnetic life of this material is greater than 100 years.

(2) Ferrite rings placed in an assembly along with steel pole pieces, constitute a standard magnet design which will provide maximum power and safe alignment of sharp iron objects to be held within the animal. Iron objects will be held parallel to the device.

(3) The use of non-magnetic, stainless steel rod threaded at each end increases dramatically the structural integrity of the device. The rod ends are flat and not likely to cause dangerous punctures in the unlikely event the device should come apart within the animal. The stainless steel rod is stronger than plastic and less subject to corrosion than a small steel screw.

Threaded end caps made of zinc plated steel tightened and locked with a permanent adhesive, will provide additional magnetic and structural strength to the assembly. The end caps physically captivate the entire assembly and are part of the magnetic circuit. The end cap at one end is a north pole and the one at the other end is a south pole and they both function as field extensions to each end of the assembly.

(4) Magnetization of the magnetic assembly, after the assembly process provides 5 percent to 10 percent increase in magnetic pull and a consistent field strength along the entire length of the assembly. The increased strength will hold iron particles more forcefully against the device. Also, magnetizing after assembly eliminates the possibility of wrong north pole or south pole placement within the assembly.

(5) Assembly time is decreased by the time it took to sort each magnet's North and South in the previous invention. Assembly time is decreased by using one hand to assemble each invention; not one hand to restrain the repelling magnets and the other to add the next magnet. Therefore two of the present invention can be assembled (one with each hand) in the time of assembling one of the old type. A vibratory feeder can be used to automate even quicker assembly when the magnets are not magnetized yet.

(6) According to my invention the non-magnetic steel rod and magnetic steel end plates are beneficial for both the magnetic strength and the structural strength of the assembly. Each steel end plate replaces the need for a steel washer to complete the magnetic circuit and a plastic end plate to hold the assembly together. Therefore the steel end plate serves two purposes in one item. This omission of elements reduces assembly time, parts costs and risk of failure due to a defective part.

(7) According to my invention this magnet has been discovered ideal for another application. It is an ideal replacement for standard fluid treatment magnets. The same farmers that are buying our cow magnet for cows found more than 20 years ago that the cow magnets of that day could be strapped to a gas line on their tractors for better mileage and decreased emissions. The cow magnet of that time was a solid Alnico pill with a North pole on one end and a South pole on the other. They still strap these on the gas lines today.

We have done testing on the best polarity configuration for fluid treatment magnets. We found that the North South North South alternating polarity provided by my invention is better than one North and one South pole. For maximum treatment the center rod can be taken out and the fluid can flow through the center or a number of magnets can be strapped on the fluid line. This same principle can be applied to water lines. It is a rarely known fact that the magnetic treatment of water to ionize and reduce scale build up also requires a North South North South alternating polarity. The dairy farmer often has irrigation pipes he can treat with these magnets. My invention is so durable that it can be reused in as many as three cows at 9–10 years each safely. It must be sterilized after each cow though. If the dairy farmer does not want to sterilize the magnet after it has served for the life of the cow he can use the magnet for fluid treatment on his farm.

(8) Another application of my invention is to demonstrate eddy current in Physics classrooms. I discovered a visual way to teach eddy currents to my employees. One magnet is dropped through a tube of aluminum or copper. It travels very slowly. One magnet is dropped through a plastic tube. It falls at the normal rate. Because of the North South North South alternating polarity the magnet sets up eddy currents in tubes made of conductors.

DRAWING FIGURES

REFERENCE NUMERALS IN DRAWINGS

1 magnet
2 pole pieces
3 center rod
4 end plates

DESCRIPTION—FIGS. 1 TO 3

Figure 1:
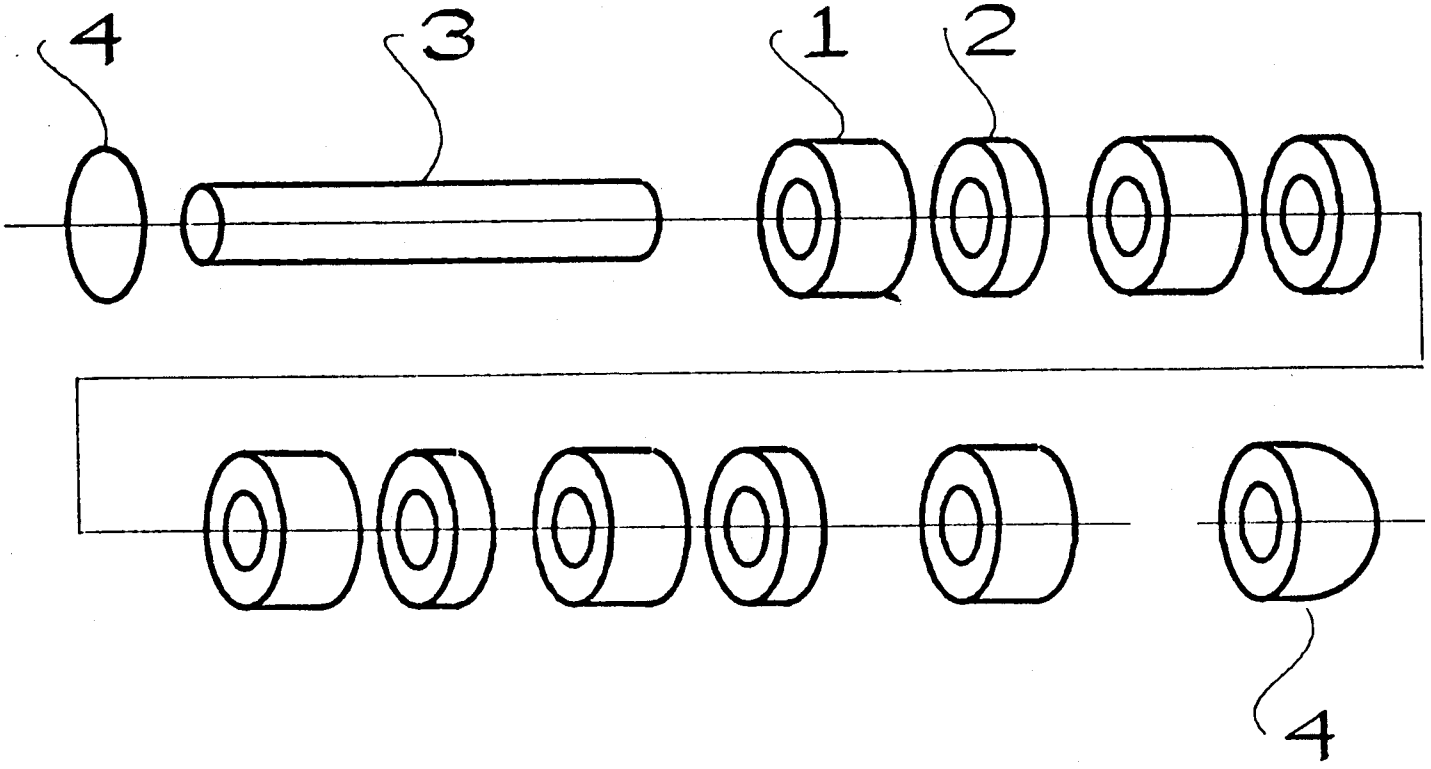
FIG. 1 is an exploded perspective view showing the preferred embodiment of the magnet assembly according to the invention.

FIG. 1 shows the assembly consists of alternately stacking unmagnetized magnet rings 1 and steel, zinc plated rings 2 on a non-magnetic stainless steel rod which is threaded 3. The complete stack is then held on the rod by steel, zinc plated end caps 4 tightened by screw action and permanently secured by adhesive on the threads. The assembly is then magnetized. It is noted that nickle or polytetraflouroethleye can be used to coat the ferrous steel parts.

Figure 2:
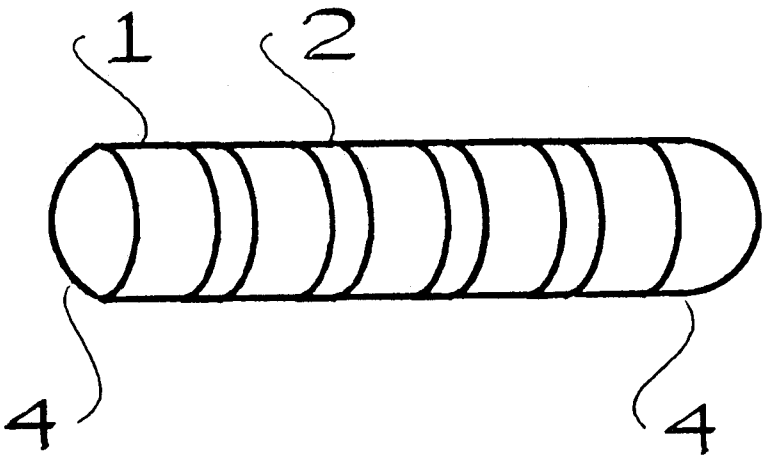
FIG. 2 is an elevational view of the magnet assembly embodiment.

FIG. 2 depicts the embodiment in the assembled condition. Overall dimensions are about 0.750" diameter × 3.00" long.

Figure 3:
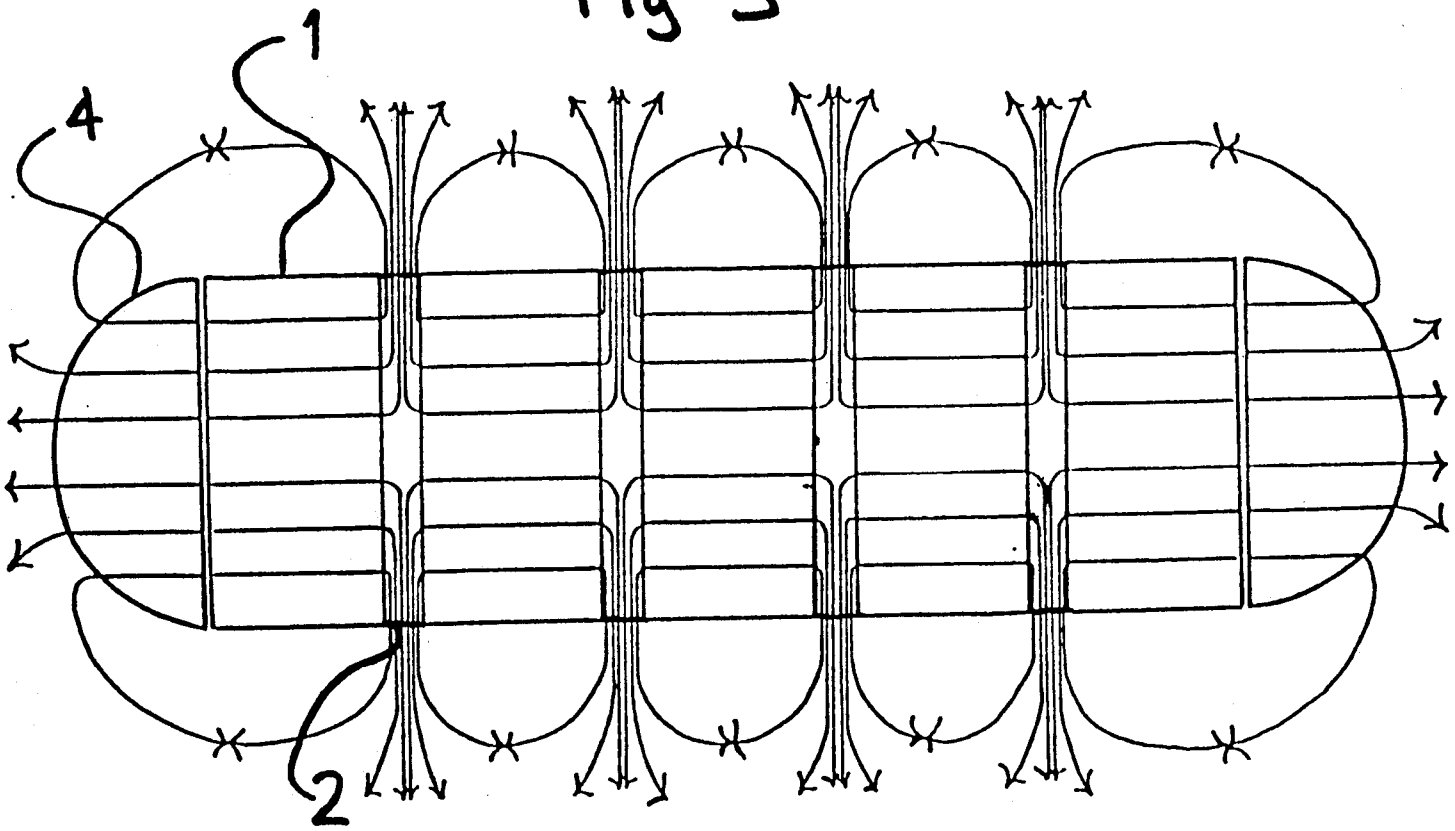
FIG. 3 is a perspective view showing the standard magnetic field of the embodiment.

FIG. 3 shows the uniform magnetic field around the magnet.

OPERATION—FIG. 2

The pill shaped cow magnet is administered orally to the cow. Due to size and weight it remains in the rumen collecting ferrous debris thereby protecting the reticulum and vital organs.

Due to its superior structural and magnetic strength the assembly works longer than the cow's lifetime. It can be reused in other cows after sterilization. If the user does not wish to sterilize the magnet it can be attached to a fuel line near the carburetor or it can be attached to a water pipe for fluid treatment. When placed on the fuel line the magnet increases gas mileage and decreases emissions. When placed on the water pipe the magnet decreases scale and ionizes the water.

SUMMARY, RAMIFICATIONS AND SCOPE

Thus the reader will see the cow magnet assembly of the invention provides the following advantages:

1) Structural and magnetic strength lasting stronger and longer than previous animal magnets.
2) Omission of Element Omission of 4 excess parts due to the synergistic use of a most durable fastening system that also serves to complete the magnetic circuit.
3) Decreased assembly time and ease of automation by magnetizing the assembly after assembling is completed.
4) No parts in the assembly are sharp enough to damage the cow in the highly unlikely event of a break up of the assembly.
5) The magnet assembly is so durable it can serve first as a cow magnet for the life of the cow, then as a fluid treatment magnet on the farm.
6) Synergism: The magnet assembly is found, because of its transformability to be an excellent visual aid for teaching eddy currents magnetic sculpturing, linear A/C motors, fluid treatment test through the center, and all other teaching visuals required for magnetics. No others assemble can include all of these uses in one magnet. The invention replaces at least 10 individual magnet kits in one unit at the sam price as one kit. At the same time, this magnet can be used for fluid treatment and protecting cow stomachs.
7) Unrecognized Problems: This design solves an unrecognized problem of breakage and damage to the cows that was not even recognized by inventors of previous animal magnets.

While my above description contains many specifications, these should not be construed as limitations on the scope of the invention, but rather as exemplification of one preferred embodiment. Other variations are possible. For example:

1) The number and size of the magnets may be varied.
2) The over all size may be varied.
3) Our invention may be used for other applications common to magnet assemblies i.e. holding, separating, electrical, etc.
4) Other non-breakable magnet and steel materials may be used.
5) Other highly permanent magnetic materials can be used as long as inside the cow they are non-toxic (toxic material including aluminum, copper, brass, etc.).

Thus the scope of the invention should be determined not by the embodiments illustrated, but by the appended claims and their legal equivalents.

I claim:

1. A magnetic device adapted to be ingested by an animal, the device comprising:

(a) a plurality of angularly shaped permanent magnets,
(b) a plurality of angularly shaped ferrous metal pole pieces, disposed between said magnets to form a longitudinal rod having a size which suffices to lodge the device in the stomach of the animal and not pass to the intestines,
(c) two end pieces, one end being disposed at each end of the rod, said end plates are rounded, angularly shaped, and made of ferrous metal; and
(d) a non-magnetic, food grade series stainless steel rod disposed through said angularly shaped magnetics and said pole pieces, said stainless steel rod being affixed to said end pieces.

2. The magnetic device of claim 1 wherein at least one said end piece is affixed to said stainless steel rod by means of a threaded fastener and an adhesive is used to lock the threads of the at least one said end plate.

3. The magnetic device of claim 1, wherein one of said end plate is formed integrally with said stainless steel rod.

4. The magnetic device of claim 1, wherein said end plates are permanently affixed to said stainless steel rod by means of press fitting.

5. The magnetic device of claim 1, wherein said pole pieces and said and caps are plated with Ni, Zr, or polytetraflouroethleye and said magnetic are coated with polytetraflouroethyleye.

* * * * *